US006171149B1

(12) United States Patent
van Zanten

(10) Patent No.: US 6,171,149 B1
(45) Date of Patent: Jan. 9, 2001

(54) HIGH SPEED CONNECTOR AND METHOD OF MAKING SAME

(75) Inventor: Albertus van Zanten, s-Hertogenbosch (NL)

(73) Assignee: Berg Technology, Inc., Reno, NV (US)

( * ) Notice: Under 35 U.S.C. 154(b), the term of this patent shall be extended for 0 days.

(21) Appl. No.: 09/221,511

(22) Filed: Dec. 28, 1998

(51) Int. Cl.[7] ..... H01R 13/648
(52) U.S. Cl. ..... 439/608; 439/885
(58) Field of Search ..... 439/608, 607, 439/609, 610, 108, 75, 79, 885

(56) References Cited

U.S. PATENT DOCUMENTS

| | | | |
|---|---|---|---|
| 4,017,770 | 4/1977 | Valfre | 361/399 |
| 4,338,717 | 7/1982 | Damon | 29/839 |
| 4,571,014 | 2/1986 | Robin et al. . | |
| 4,806,107 | 2/1989 | Arnold et al. | 439/79 |
| 4,846,727 | 7/1989 | Glover et al. | 439/608 |
| 5,066,236 | 11/1991 | Broeksteeg | 439/79 |
| 5,104,341 | 4/1992 | Gilissen et al. | 439/608 |
| 5,174,770 | 12/1992 | Sasaki et al. | 439/108 |
| 5,460,533 | 10/1995 | Broeksteeg et al. | 439/101 |
| 5,522,727 | 6/1996 | Saito et al. | 439/65 |
| 5,664,968 | 9/1997 | Mickievicz | 439/608 |
| 5,795,191 | 8/1998 | Prepunick et al. | 439/608 |
| 5,993,259 * | 11/1999 | Stokoe et al. | 439/608 |

FOREIGN PATENT DOCUMENTS

WO97/02627 1/1997 (WO) .

* cited by examiner

*Primary Examiner*—Neil Abrams
*Assistant Examiner*—Eugene G. Byrd
(74) *Attorney, Agent, or Firm*—Brian J. Hamilla; M. Richard Page

(57) ABSTRACT

A terminal frame at least partially locatable within an insulative housing of an electrical connector and having: a plurality of contacts and bridges extending between adjacent contacts. An electrical connector formed from a plurality of modules, each module having: an insulative housing; a plurality of first contacts at least partially surrounded by said insulative housing; bridges extending between adjacent first contacts; a plurality of second contacts; and a substrate having conductive traces thereon extending between at least some of the first and second contacts. A method of making an electrical connector, including the steps of: providing a plurality of modules and arranging the modules. The module providing step comprises the steps of: providing a terminal frame with a plurality of first contacts and a bridge extending between adjacent first contacts; providing an insulative housing; at least partially surrounding the terminal frame with the insulative housing; providing a plurality of second contacts; providing a substrate with conductive traces thereon; connecting the first and second contacts to the conductive traces on the substrate.

47 Claims, 13 Drawing Sheets

HIGH SPEED CONNECTOR AND METHOD OF MAKING SAME

CROSS-REFERENCE TO RELATED APPLICATIONS

This application is related to U.S. patent application Ser. Nos. 08/784,743 and 08/784,744, both filed on Jan. 16, 1997, U.S. Ser. No. 08/973,811 filed on Dec. 9, 1997, U.S. Ser. No. 08/974,536 filed on Nov. 19, 1997 and U.S. Ser. No. 09/113,579 filed on Jul. 10, 1998, all of which are herein incorporated by reference.

BACKGROUND OF THE INVENTION

1. Field of the Invention

The present invention relates to electrical connectors. More specifically, the present invention relates to high speed electrical connectors.

2. Brief Description of Earlier Developments

Various types of connectors used in high speed applications exist. One type of high speed connector uses a series of sub-assemblies or modules arranged side-by-side. Each module in the connector typically includes contact terminals, a substrate with traces that conduct signals between the contact terminals and a spacer separating adjacent modules. Arranging a given number of modules forms the electrical connector.

Satisfactory operations of these connectors at such high speeds demands a more precise assembly of the connector and modules than with low speed connector. As a result, the assembly process is usually slower and may involve more steps than the assembly of low speed connectors. The cost of assembling such connectors, therefore, may be higher than the assembly cost of low speed connectors.

SUMMARY OF THE INVENTION

It is an object of the present invention to provide an improved electrical connector.

It is a further object of the present invention to form an electrical connector having reduced production costs.

It is a further object of the present invention to form the electrical connector from a plurality of modules, or sub-assemblies.

It is a further object of the present invention to form the electrical connector from modules incorporating printed circuit boards (PCBs).

It is a further object of the present invention to use adjacent modules in the electrical connector as a differential pair.

It is a further object of the present invention to provide the module with an insulative housing surrounding at least a part of a terminal frame.

It is a further object of the present invention to simultaneously manufacture a plurality of modules.

It is a further object of the present invention to overmold the insulative housing over the terminal frame.

It is a further object of the present invention to provide the electrical connector with a dual beam ground contact for engaging the side walls of grooves in a conductive header shroud, one beam formed by the terminal frame of one module, the other beam formed by the terminal frame of an adjacent module.

It is a further object of the present invention to provide an improved terminal frame.

It is a further object of the present invention to provide a terminal frame capable of use in a plurality of modules that form an electrical connector.

It is a further object of the present invention to provide a severable terminal frame for selectively separating contacts from the frame.

These and other objects of the present invention are achieved in one aspect of the present invention by a terminal frame at least partially locatable within an insulative housing of an electrical connector. The terminal frame has a plurality of contacts and a bridge extending between adjacent contacts.

These and other objects of the present invention are achieved in another aspect of the present invention by an electrical connector formed from a plurality of modules. Each module has: an insulative housing; a plurality of first contacts at least partially surrounded by the insulative housing; a plurality of second contacts; and a substrate having conductive traces thereon extending between at least some of the first and second contacts.

These and other objects of the present invention are achieved in another aspect of the present invention by a method of making an electrical connector. The method includes the steps of: providing a plurality of modules; and arranging the modules. The modules are formed by the steps of: providing a terminal frame with a plurality of first contacts and bridges extending between adjacent contacts; providing an insulative housing; at least partially surrounding the terminal frame with the insulative housing; providing a plurality of second contacts; providing a substrate with conductive traces thereon; connecting the first and second contacts to the conductive traces on the substrate.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

Generally, the present invention relates to a modular connector formed by a plurality of sub-assemblies. Each sub-assembly comprises several components, including a terminal frame supporting a first set of contacts within a housing. A second set of contacts also reside in the housing. Finally, each assembly includes a substrate, such as a PCB, secured to the housing. The substrate has conductive traces for connecting contacts located at each end of the trace. The sub-assemblies, when placed side-by-side, form the connector. Each sub-assembly can have corresponding features to secure the adjacent modules together, or the connector can use a retainer or housing to surround the sub-assemblies and hold the sub-assemblies together.

Figure 1:
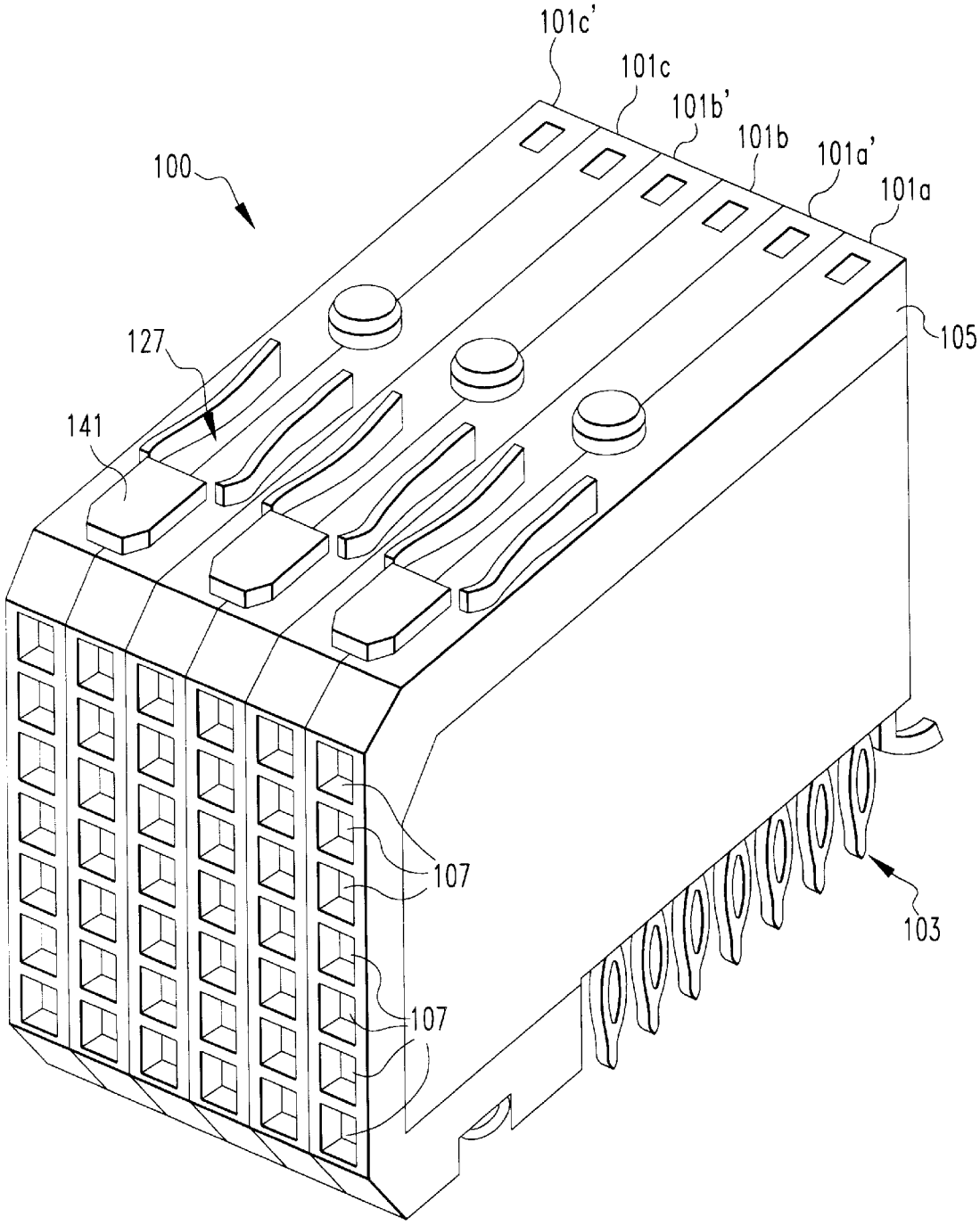
FIG. 1 is a perspective view of one embodiment of a connector of the present invention.
Figure 2:
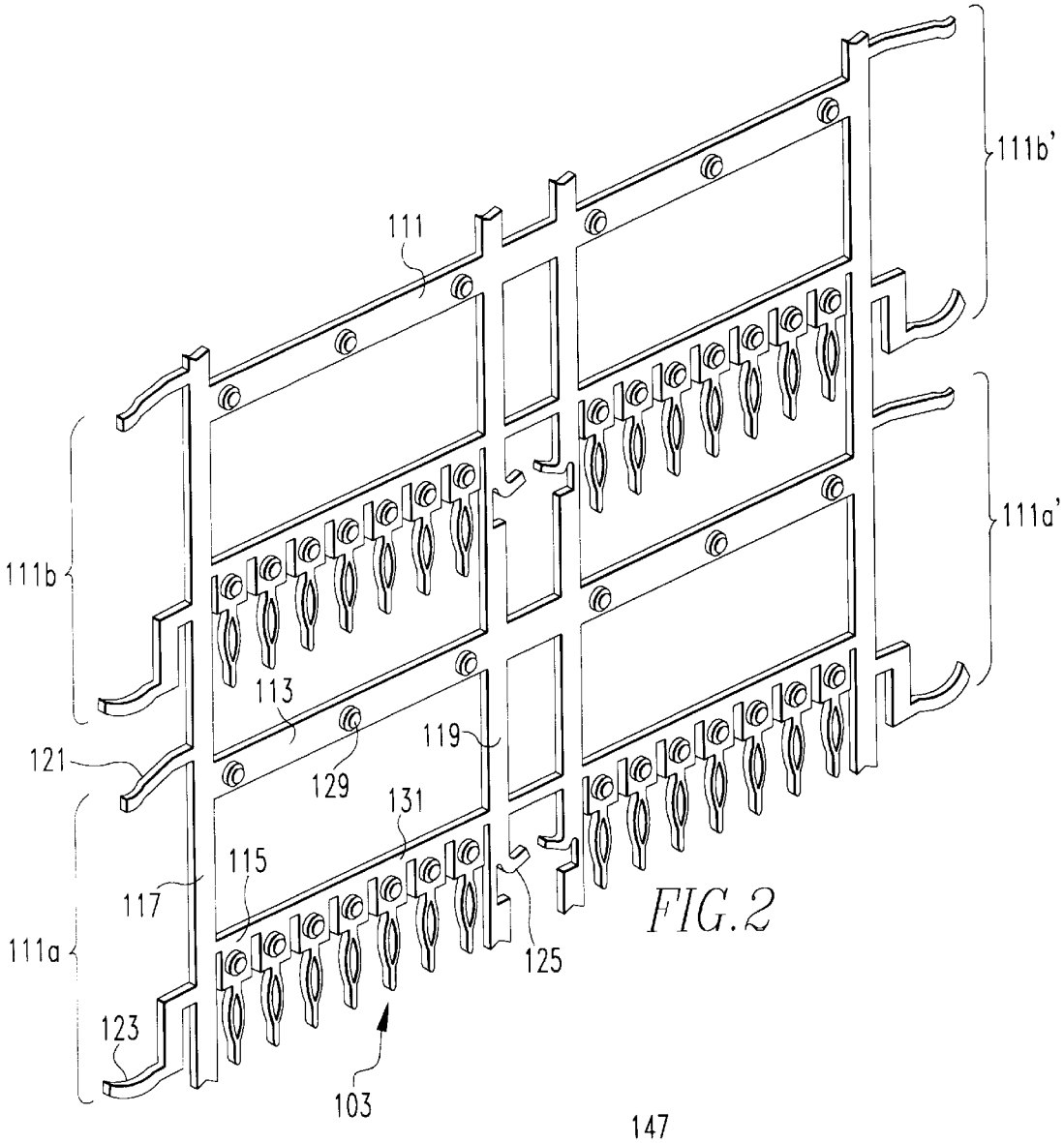
FIG. 2 is a perspective view of one component used in the connector shown in FIG. 1.

FIGS. 1–9 will be used to describe one alternative embodiment of the present invention. As seen in FIG. 1, modular electrical connector 100 is formed by a number of adjacent modules, or sub-assemblies 101*a*, 101*a*', 101*b*, 101*b*', 101*c*, 101*c*'. Each sub-assembly includes a first set of contacts 103 disposed along an edge of connector 100, an insulative housing 105, a second set of contacts 107 disposed along another edge of connector 100, and a PCB 109. Each component of the sub-assembly will now be individually described.

Figure 16A:
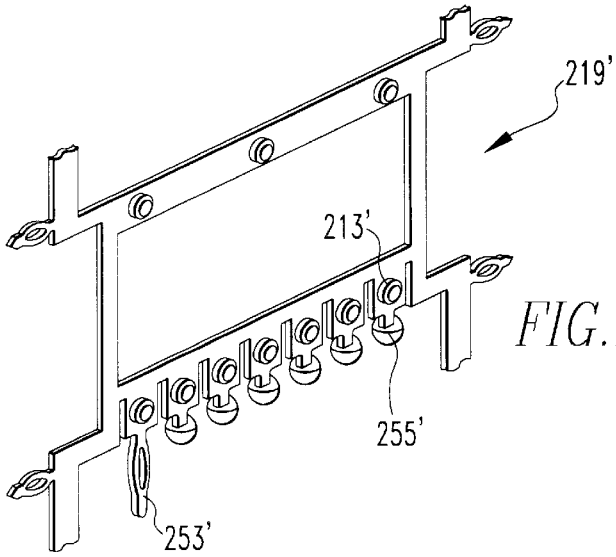
FIGS. 16*a*–16*c* display various alternative embodiments of the component shown in FIG. 11.
Figure 16B:
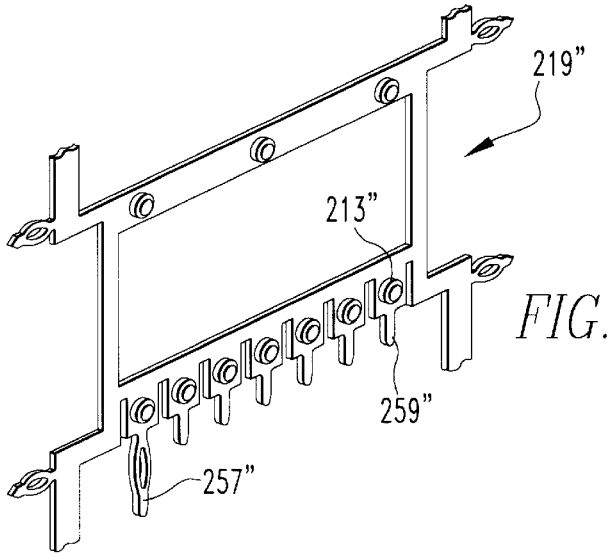
Figure 16C:
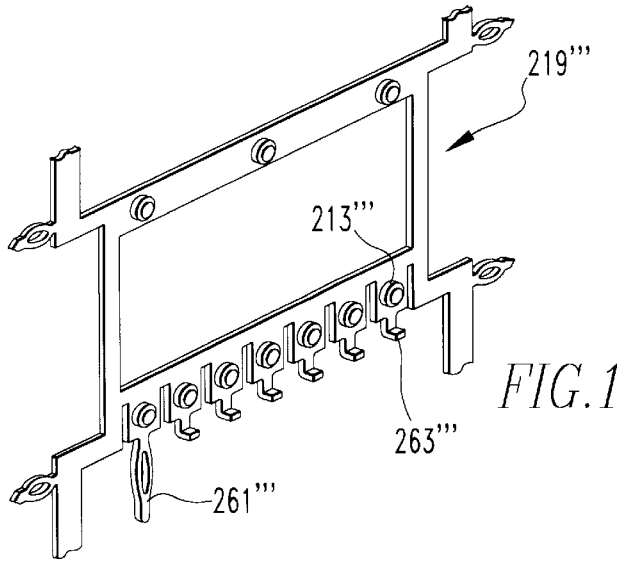

Contacts 103 can secure the connector to a substrate (not shown) using the press-fit features shown in FIG. 1 or in any other manner, such as using solder balls (see FIG. 16*a*), through-hole mounting (see FIG. 16*b*), or surface mounting (see FIG. 16*c*).

A terminal frame 111 provides contacts 103 to connector 100. Frame 111, preferably contiguous, can be stamped and formed from a sheet of a suitable conductive material. Although frame 111 may form only one sub-assembly (not shown), the figures display a continuous frame 111 with columns of terminal frame sections 111*a*, 111*b*, 111*a*', 111*b*' that form a number of sub-assemblies 101*a*, 101*a*', 101*b*, 101*b*'.

The first column of frame sections 111*a*, 111*b* can be identical to each other. Thus, only a description of one frame section 111*a* follows. Frame section 111*a* has an upper member 113, a lower member 115, forward member 117 and a rear member 119. Contacts 103 extend from lower member 115. At this point of the assembly of connector 100, a bridge 131 preferably extends entirely between adjacent contacts 103. Frame section 111*a* may have auxiliary contacts 121, 123 extending from forward member 117 and an auxiliary tab 125 extending from rear member 119. Auxiliary contacts 121, 123 and auxiliary tab 125 may be used for grounding or any other purpose. For instance, when connector 100 is fully assembled, auxiliary contact 121 may interact with an auxiliary contact on an adjacent sub-assembly 101 to form a dual beam contact 127 (see FIG. 1).

Dual beam contact 127 may receive, for example, a ground pin (not shown) from the mating connector (not shown) or side walls (not shown) of grooves (not shown) in a conductive header shroud (not shown). Auxiliary contact 123 may also electrically connect connector 100 with a conductive header shroud (not shown) of the mating connector, a contact (not shown) on the mating connector, or a ground trace located on the substrate (not shown) to which connector 100 mounts. Auxiliary tab 125 may be surface mounted on the substrate to which connector 100 mounts using, for example, solder. This feature adds rigidity to connector 100.

Frame section 111*a* can also have alignment posts 129 extending therefrom. Posts 129 help align terminal frame 111 during formation of housing 105 and act as solder pads to secure PCB 109 to housing 105. These features will be described in more detail below. In a stamped frame 111, posts 129 can be dimples formed during the stamping process or during the molding operation (e.g. when closing the mold).

As used throughout, the phrase "single ended" refers to a scenario in which each transmission line carries a different signal. The phrase "differential pair," as exemplified in FIGS. 9 and 13, refers to a scenario in which two transmission lines carry a common signal, but complementary in voltage. The phrase "row-oriented differential pair," as exemplified in FIG. 9, refers to the pairing of transmission lines that reside in different sub-assemblies. The phrase "column-oriented differential pair," as exemplified in FIG. 13, refers to the pairing of transmission lines that reside in the same sub-assembly.

In single ended connectors and in column-oriented differential pair connectors, adjacent sub-assemblies may be formed generally identical to each other. In such an arrangement, terminal frame 111 could have columns of sections (e.g. 101*a*, 101*b*) that are generally identical to each other.

In row-oriented differential pair connectors, it may be useful to have adjacent sub-assemblies (e.g. 101*a*, 101*a*') formed generally as mirror images of each other. In such an arrangement, terminal frame 111 includes sections 111*a*', 111*b*' that are generally mirror images of adjacent sections 111*a*, 111*b*. Since frame sections 111*a*', 111*b*' are generally identical to sections 111*a*, 111*b* save the mirror image relationship, no discussion of the mirror image sections 111*a*', 111*b*' is needed.

Figure 7:
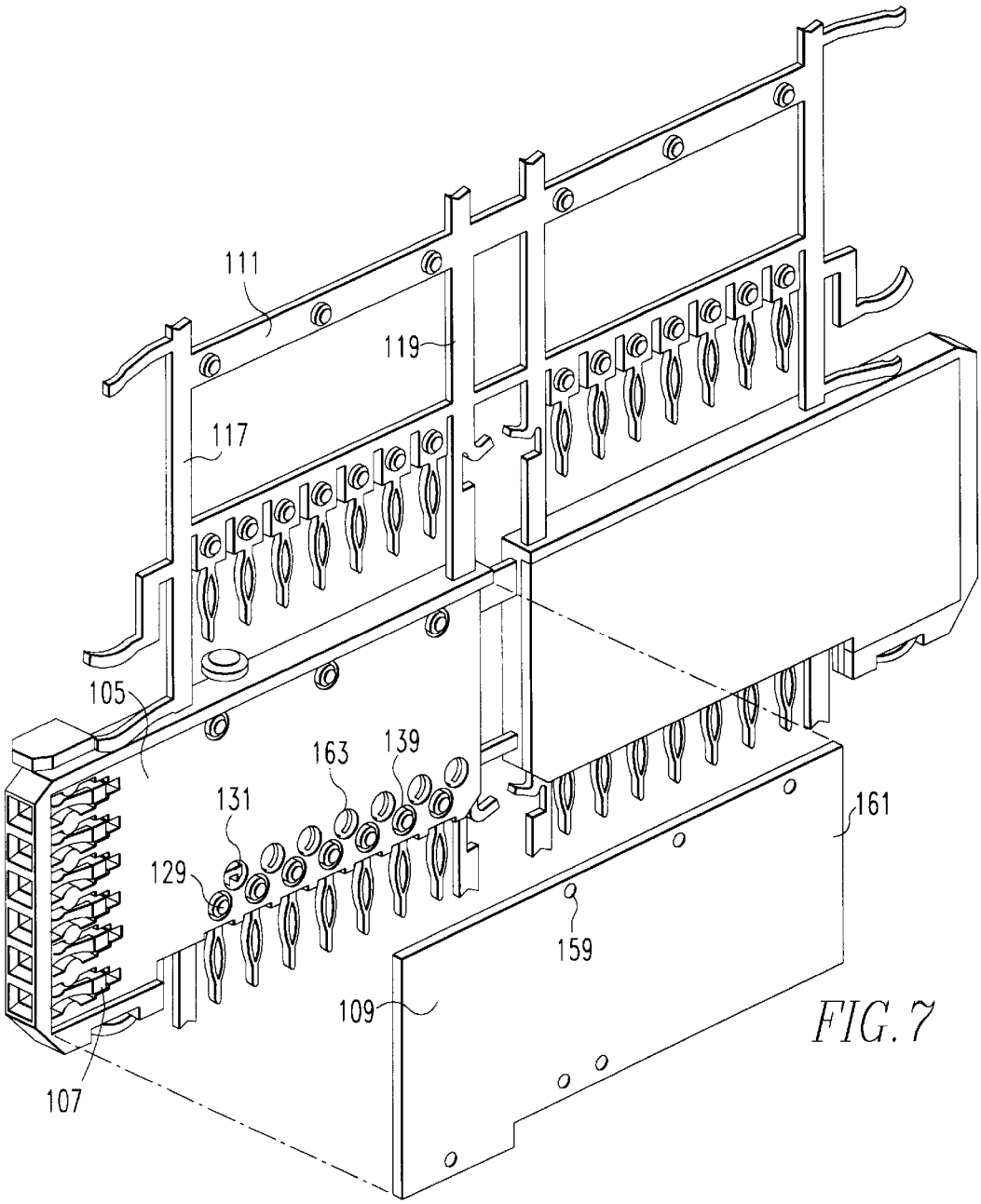
Figure 7A:
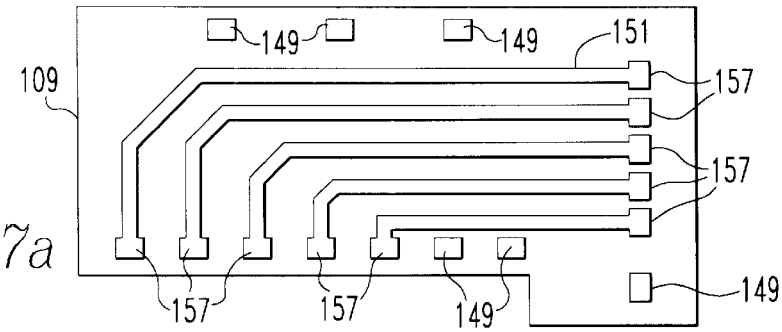
FIG. 7*a* is a side view of one component shown in FIG. 7.

Housing 105 will now be described with reference to FIGS. 4 and 5. Housing 105 has a front face with lead-ins 133 that receive pins (not shown) from the mating connector. A cavity 135 communicates with lead-ins 133 and is sized to receive a contact 107 that engages the pin from the mating connector. Each cavity 135 can include rounded projections 155 located to prevent overstressing of dual beams 145 of contact 107 during insertion of a mating pin. One side of housing 105 can have a recessed portion 137 sized to accept PCB 109 as shown in FIGS. 7 and 7*a*. Housing 105 also has apertures 139, 163 that correspond to the locations of projections 129 and bridges 131, respectively, on frame 111. Some housings 105 can have keys 141 (see FIG. 4) that engage a corresponding groove (not shown) in the mating connector for alignment purposes. Keys 141 extend to the side of housings 105. When placed beside another housing 105, key 141 centrally locates on the top surface formed by the adjacent housings 105, 105 as seen in FIG. 1.

Housings 105 from adjacent sub-assemblies can have corresponding features to secure, preferably by snap-fit, the sub-assemblies together to form connector 100. The features could be, for example, a protuberance (not shown) on one housing 105 receivable by an opening (not shown) on an adjacent housing 105'. Other assembly techniques, such as dove tail grooves, could also be used.

Figure 3:
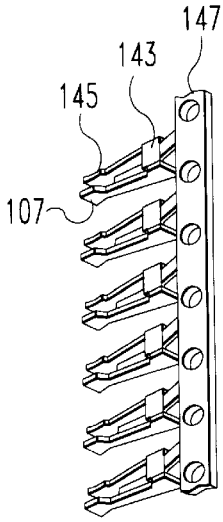
FIG. 3 is a perspective view of another component used in the connector shown in FIG. 1.

Contact 107 will now be described. As shown in FIG. 3, contact 107 has a central portion 143 flanked by dual beams 145 that preferably creates a U-shaped cross-section. Central portion 143 acts as a solder pad for securing PCB 109 to housing 105 as described below. Dual beams 145 of contacts 107 engage the pins of the mating connector.

PCB 109 will now be described with reference to FIGS. 7 and 7*a*. PCB 109 can be formed from a suitable dielectric material such as FR4. As seen in FIG. 7*a*, PCB 109 includes a series of conductive pads 149, 157. Pads 149, 157 allow contacts 103, 107 to secure to PCB 109 in a manner discussed below.

Vias, or plated through holes, 159 can join pads 149 with a conductive element on the opposite side of PCB 109. As shown in FIG. 7*a*, the opposite side of PCB 109 could be entirely conductive, forming a ground plane 161. Rather than being entirely conductive (i.e. a ground plane), the opposite side of PCB 109 could have conductive traces (not shown) thereon. In the specific embodiment shown in FIGS. 1–9, contacts 103, 107 that engage pads 149 carry ground.

Conductive traces 151 extend between pads 157. This allows the transmission of a signal between contact 107 at one end of trace 151 and contact 103 at the opposite end of trace 151. Not all traces 151, however, must carry a signal. Some traces 151, for example, may carry ground or power. The present invention allows for selective configuration of the use of contacts 103, 107 and traces 151.

Although the above description allotted one PCB 109 to each sub-assembly, different arrangements are possible. With one PCB 109 per sub-assembly as shown in FIG. 7*a*, pads 149, 157 reside only on one side of PCB 109. Alternatively, two sub-assemblies arranged for roworiented differential pairing could utilize a common PCB (not shown). When compared to a lead frame, PCB 109 allows for more flexible manufacturing. For example, traces 151 on PCB 109 could connect contacts 103 to contacts 107 in virtually any order or pattern. Lead frames, on the other hand, are limited to connecting specific contacts in a specific arrangement.

The assembly of connector 100 will now be described with reference to at least FIGS. 4, 5, 6, 7 and 8. Either manual, semi-automated or automated processes can perform these steps. Furthermore, the present invention does not require the performance of all steps, nor does the present invention require that the steps occur in the exact order described.

Figure 4:
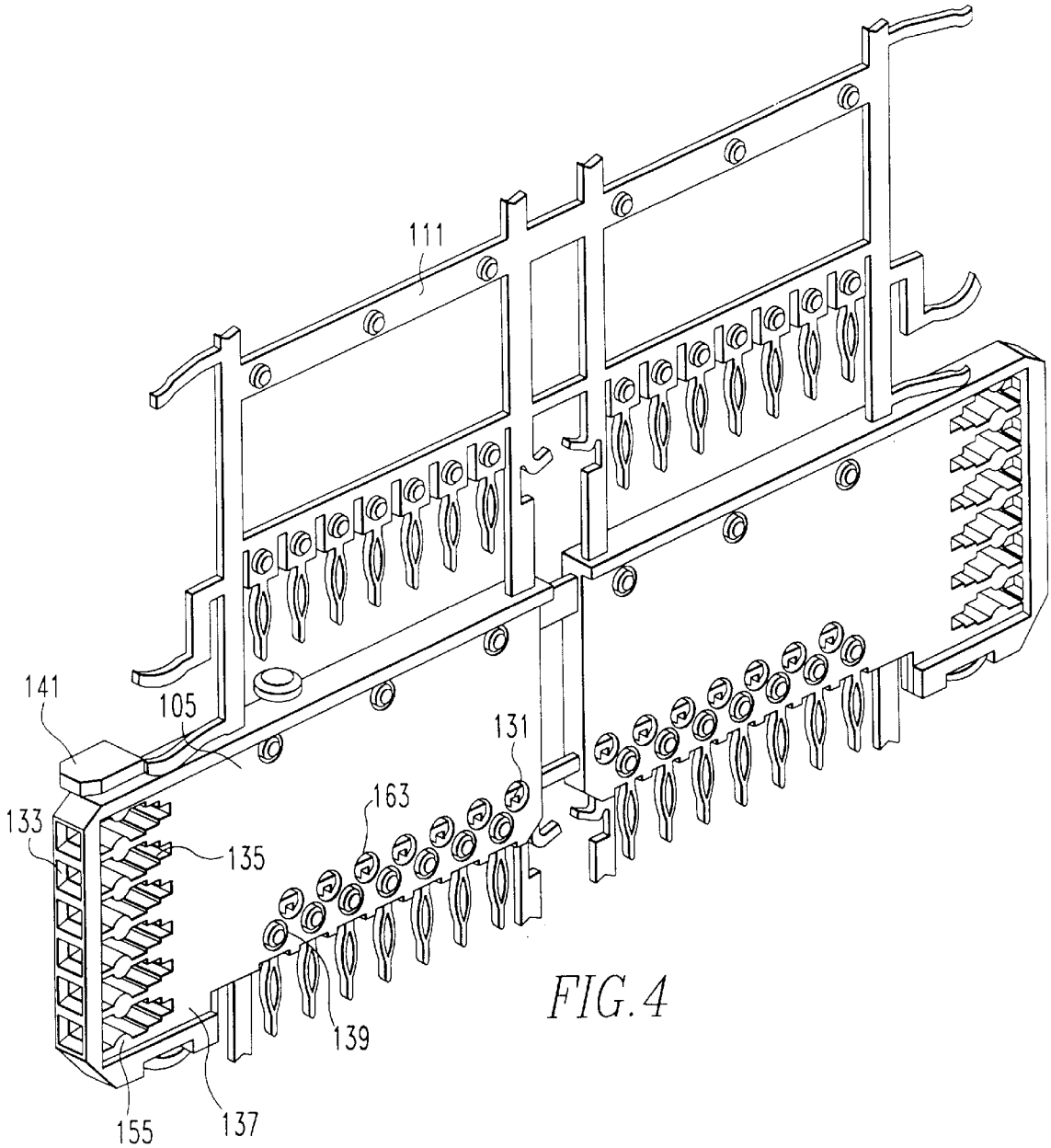
FIGS. 4, 5, 6, 7, 8 and 9 display various stages during the assembly of the connector shown in FIG. 1.

FIG. 4 demonstrates one step in the assembly of connector 100. This step involves forming housing 105 in conjunction with terminal frame 111. Housing 105 should encase at least a portion of frame 111, preferably by forming housing 105 around frame 111.

One possible method of encasing terminal frame 111 within housing 105 overmolds housing 105 around frame 111 using known injection molding techniques. Terminal frame 111 is initially positioned within a mold (not shown). Then, a suitable plastic material enters the mold and surrounds frame 111. As a result, the insulative material of housing 105 encases at least a portion of frame 111. Housing 105 forms, in essence, a unitary structure with frame 111.

In the overmolding method shown in FIG. 4, the insulative material forming housing 105 surrounds bridges 131. In other words, bridges 131 reside within housing 105 after the overmold step. In order to sever bridges 131 in a subsequent assembly step, the overmolding process preferably forms apertures 163 on both sides of housing 105. Features on the mold create apertures 163 by preventing the injected material from approaching bridges 131.

Also in the overmolding method shown in FIG. 4, the insulative material forming housing 105 surrounds posts 129. In order to allow posts 129 to secure to PCB 109 in a subsequent assembly step, the overmolding process preferably forms apertures 139 in housing 105. Features on the mold prevent the injected material from entering approaching posts 129.

Figure 4A:
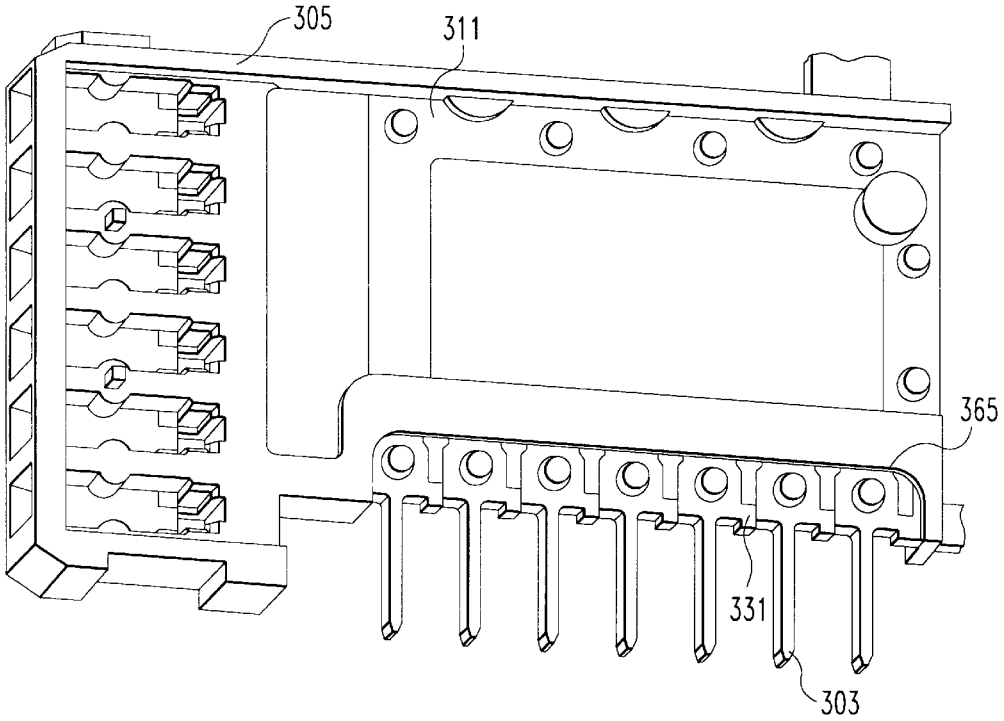
FIG. 4*a* is a perspective view of several components of another embodiment of the present invention.

In the alternative overmolding method shown in FIG. 4*a* (with like features using the same reference character save a change in the hundred digit), bridges 331 that extend between adjacent contacts 303 on terminal frame 311 extend from housing 305. In other words, bridges 331 do not reside within housing 305. Rather, as shown in FIG. 4*a*, housing 305 has a notched area 365 which reveals bridges 331. Notched area 365 provides easier access to bridges 331 than the earlier embodiment. Although described above as being overmolded, housing 105 could be made using other methods. For instance, housing 105 could have two pieces. The two pieces of housing 105 would sandwich terminal frame 111, thereby surrounding frame 111.

As seen in FIG. 4, portions of terminal frame 111 can extend from housing 105. Specifically, contacts 103, auxiliary contacts 121, 123 and auxiliary tab 125 preferably extend from housing 105. Conversely, housing 105 surrounds the remainder of upper member 113, lower member 115, forward member 117 and rear member 119.

Figure 5:
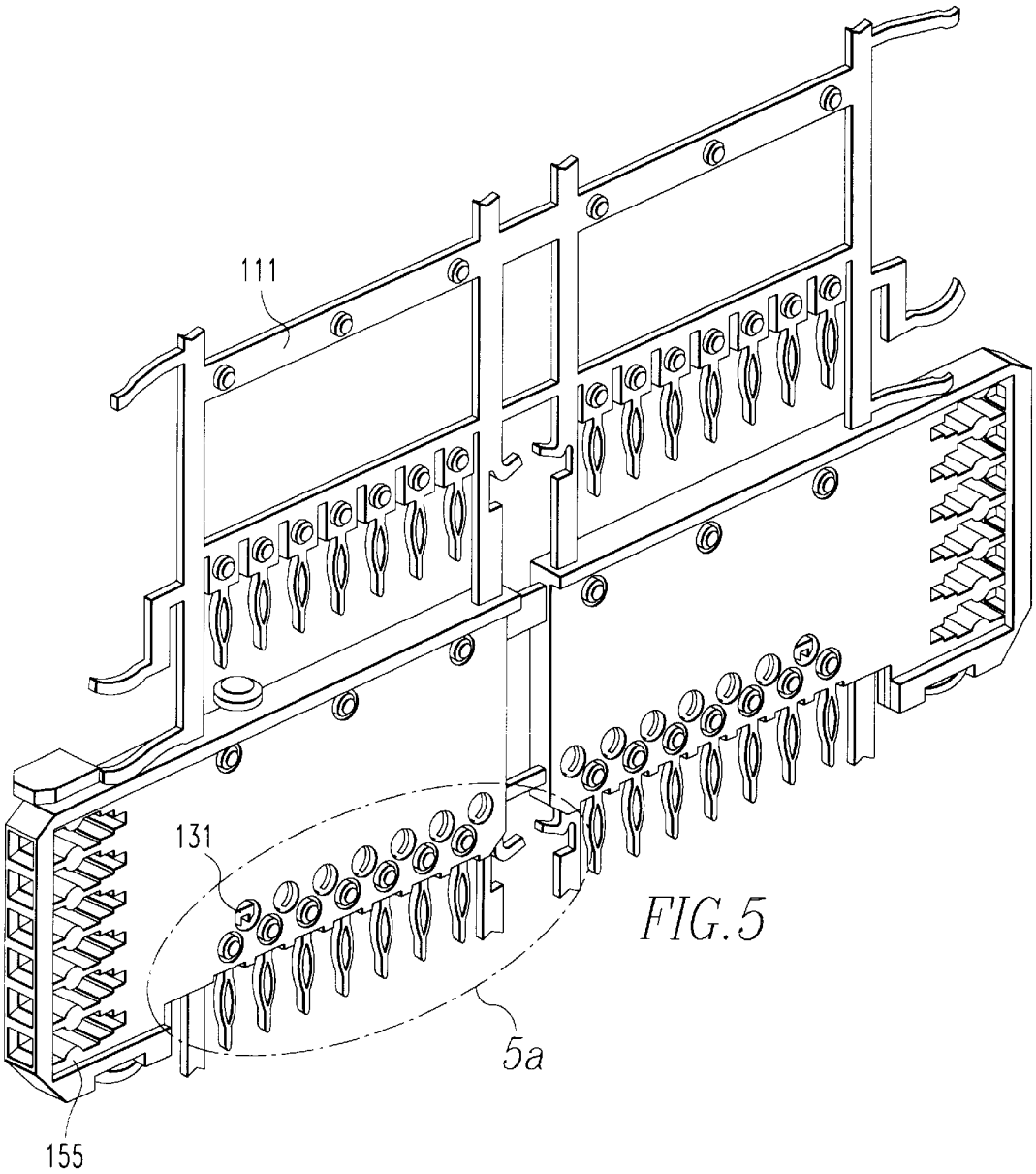

FIG. 5 demonstrates another step in the assembly process. This step separates at least one contact 103 from terminal frame 111. FIG. 5 demonstrates several severed bridges 131 in terminal frame 111. As used throughout, the term "bridge" can refer to a portion of terminal frame 111 that extends entirely between adjacent contacts 103 (i.e. continuous) or a severed portion of terminal frame 111 between adjacent contacts 103 (i.e. discontinuous) as seen in FIG. 5*a*.

Figure 5A:
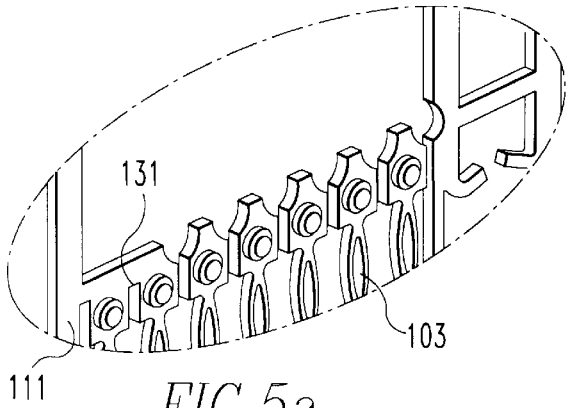
FIG. 5*a* is a detailed view of one component shown in FIG. 5.

FIG. 5*a* demonstrates the appearance of terminal frame 111 within housing 105 with severed bridges 131. This step can be accomplished, for example, by inserting tooling (not shown) in selective apertures 163 to sever one or more bridges 131. The presence of two apertures 163 per bridge 131 allows the tooling to enter from either side, or both sides, of housing 105 to sever bridge 131.

The present invention allows for the severing of any combination of bridges 131 to achieve a desired result. FIG. 5 shows one possible arrangement, in which the five rearward contacts 103 are severed from terminal frame 111 and from each other. Stated differently, the five rearward contacts 103 are discontinuous with frame 111 and with each other. Preferably, at least some of these five contacts 103 conduct signals. As discussed above, the present invention is not limited to the specific arrangement shown in FIG. 5.

The two forward contacts 103 can remain contiguous with terminal frame 111 and with each other. Preferably, the two forward contacts 103 are ground or power contacts. Since the two forward contacts 103 remain contiguous with frame 111, these contacts 103 are also contiguous with auxiliary contacts 121, 123 and auxiliary tab 125. As a result, the two forward contacts 103, the contiguous portions of frame 111, auxiliary contacts 121, 123 and auxiliary tab 125 can provide shielding to module 101 and to connector 100.

In situations, such as with the alternative embodiment shown in FIG. 4*a*, where notched area 365 reveals bridges 331, the tooling can sever selected bridges 331 in any conventional manner. The tooling need not enter openings in housing 305 as described with the previous embodiment.

Figure 6:
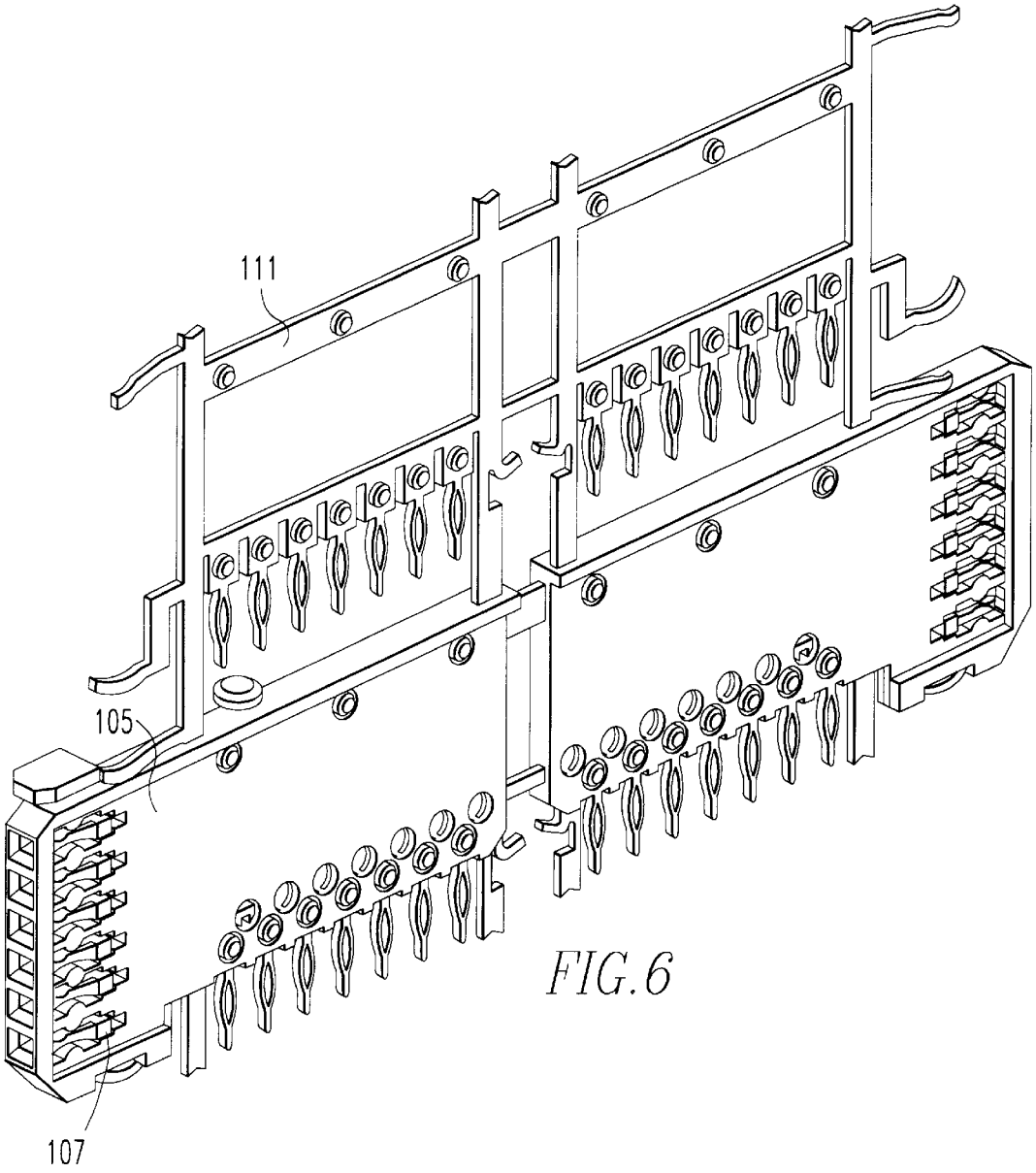

FIG. 6 demonstrates another step in the assembly process. This step places contacts 107 in housing 105. In order to facilitate placement of contacts 107 in housing 105, contacts 107 can reside on a carrier strip 147. Contacts 107 are severed from carrier strip 147 and are retained within cavity 135 during the assembly process using, for example, an interference fit.

FIG. 7 demonstrates another step in the assembly process. This step merges housing 105 and PCB 109. As an example of one possible method, solder paste (not shown) is placed on pads 149, 157 of PCB 109. Then, PCB 109 is inserted into recess 137 of housing 105, with some pads 149, 157 aligned with posts 129 and other pads 149, 157 aligned with central portions 143 of contacts 107. A known reflow step melts the solder paste and joins pads 149 with posts 129 and central portions 143 of contacts 107. This step could also be performed, for example, using laser welding.

Figure 8:
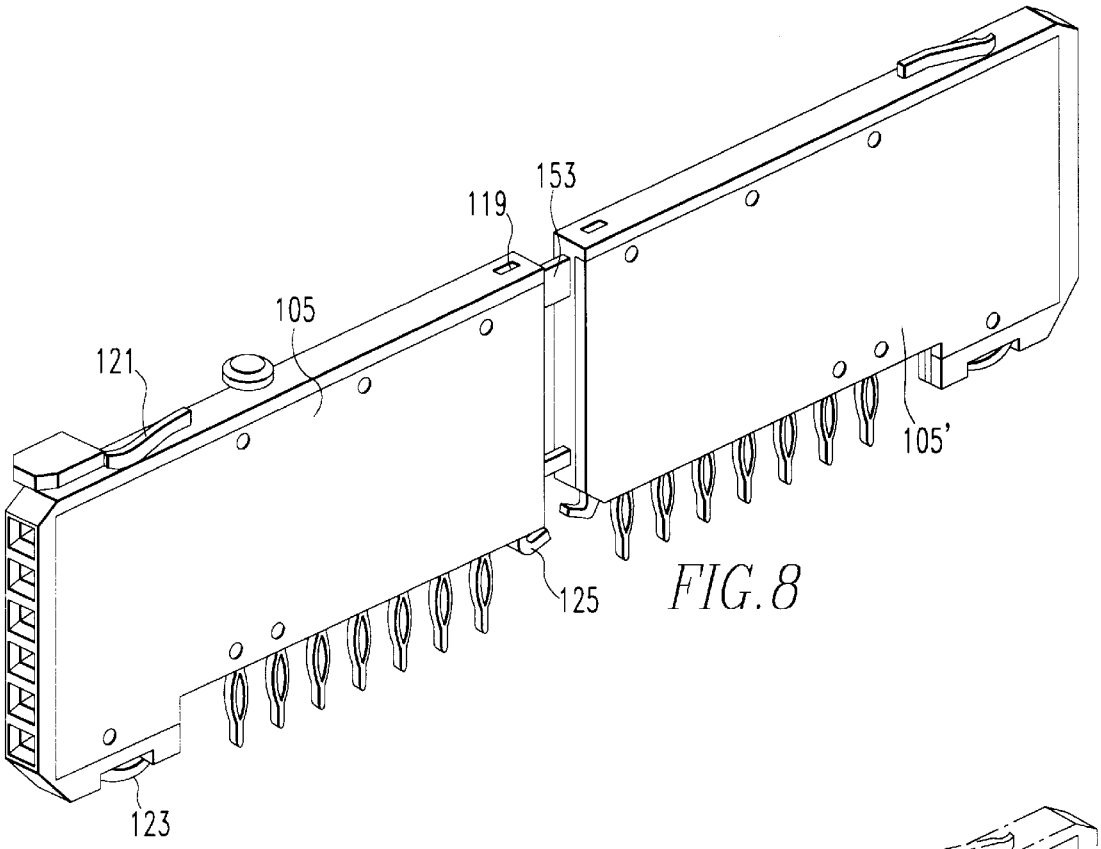

FIG. 8 demonstrates another step in the assembly process. This step severs terminal frame section 111*a* associated with housing 105 from the remainder of frame 111. Specifically, this step severs frame section 111*a* at four locations: the portion of forward member 117 extending from the top of housing 105 at a location above auxiliary contact 121; the portion of forward member 117 extending below auxiliary tab 123; the portion of rear member 119 extending from the top of housing 105; and the portion of rear member 119 extending below auxiliary tab 125. This step is needed only when terminal frame 111 forms more than one sub-assembly 101 as shown in FIGS. 7 and 8.

Figure 9:
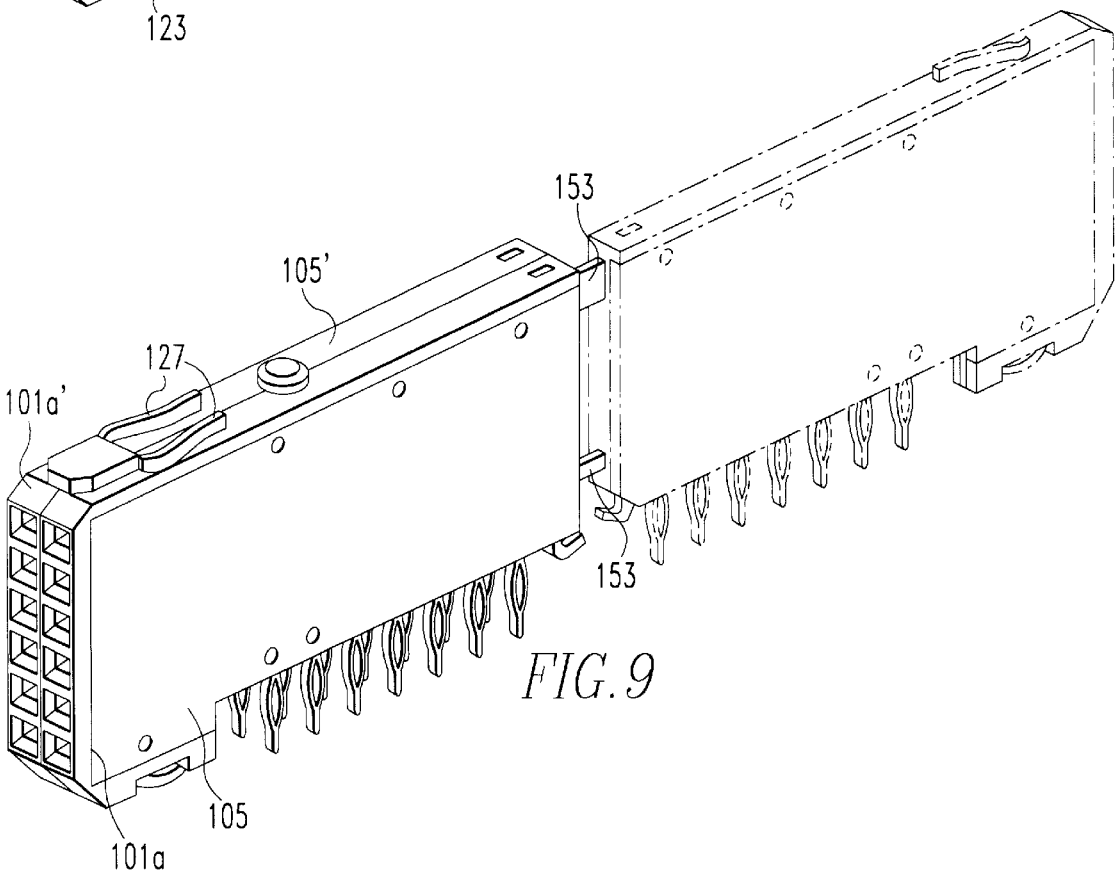

FIG. 9 demonstrates another step in the assembly process, typically used with row-oriented differential pair arrangements. At least one junction 153 extends between mirror image terminal frame sections 111*a*, 111*a*' that reside in housings 105, 105' for continuity of the differential pair modules. This step aligns the front faces of housings 105, 105'. Preferably, this step bends junctions 153 to align the front faces of housings 105, 105'. When housings 105, 105' are placed side-by-side, junctions 153 connect terminal frame sections 111*a*, 111*a*'. This feature provides additional grounding benefits useful in high speed applications.

FIG. 1 displays an assembled connector 100 formed from a series of sub-assemblies 101 arranged side-by-side. Sub-assemblies 101 can secure together using corresponding features on each sub-assembly 101, or by surrounding the side-by-side sub-assemblies 101 with a retainer, such as a metal shield (not shown), or a plastic housing (not shown). Although FIG. 9 displays connector 100 as a right angle receptacle, the present invention is not limited to this specific embodiment. For instance, FIGS. 10–15 and 17 demonstrate the present invention could be a right angle header. Further, the present invention could also be a straight connector (not shown).

Figure 10:
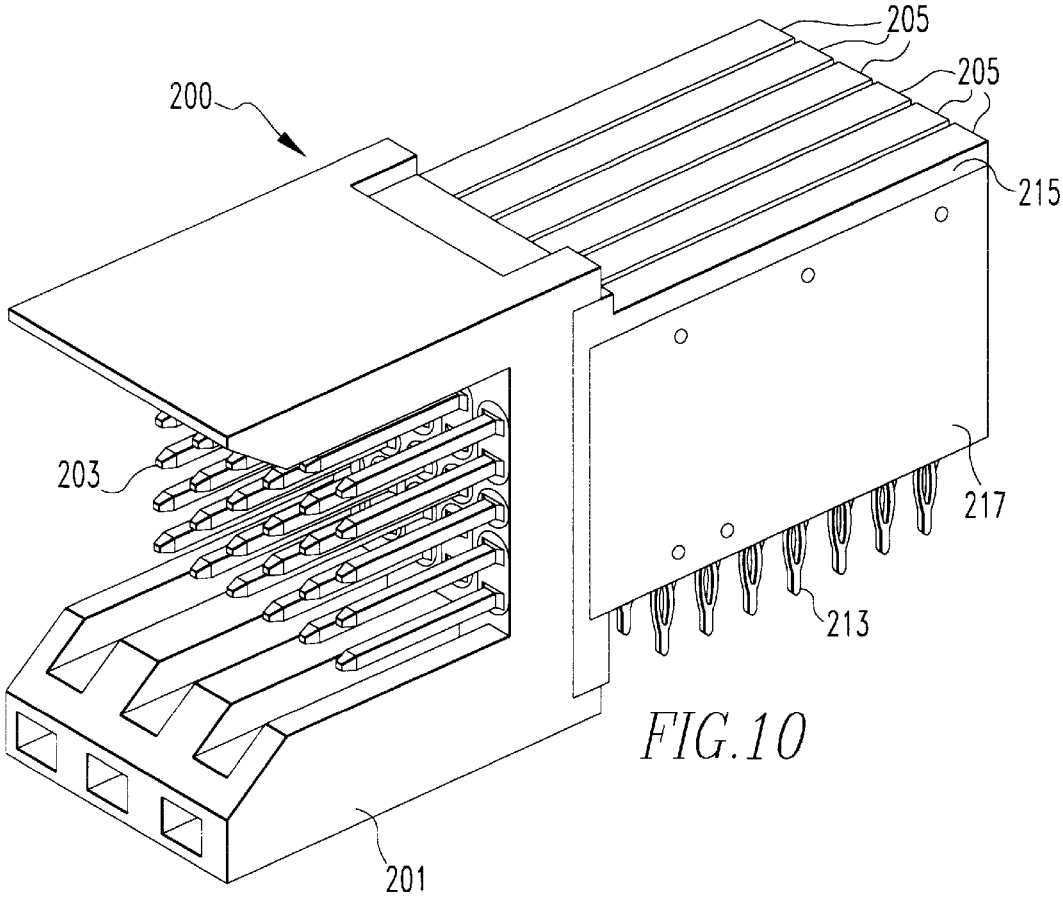
FIG. 10 is a perspective view of another embodiment of a connector of the present invention.

FIGS. 10–15 will be used to describe another alternative embodiment of the present invention. As seen in FIG. 10, modular electrical connector 200 has a shroud 201, pins 203 and a number of adjacent modules, or sub-assemblies 205.

Shroud 201 will now be described with reference to FIG. 15. Shroud 201 has a base section and walls extending from the base section. Shroud 201 can be made from either an insulative material or a conductive material.

The walls include a series of grooves 207 that receive keys (not shown) from a mating connector to aid in the alignment of connector 200 with the mating connector. The walls also include openings 209 that can receive, for example, a latch (not shown) that secures connector 200 to the mating connector. The base of shroud 201 includes apertures 211 through which pins 203 extend.

Figure 12:
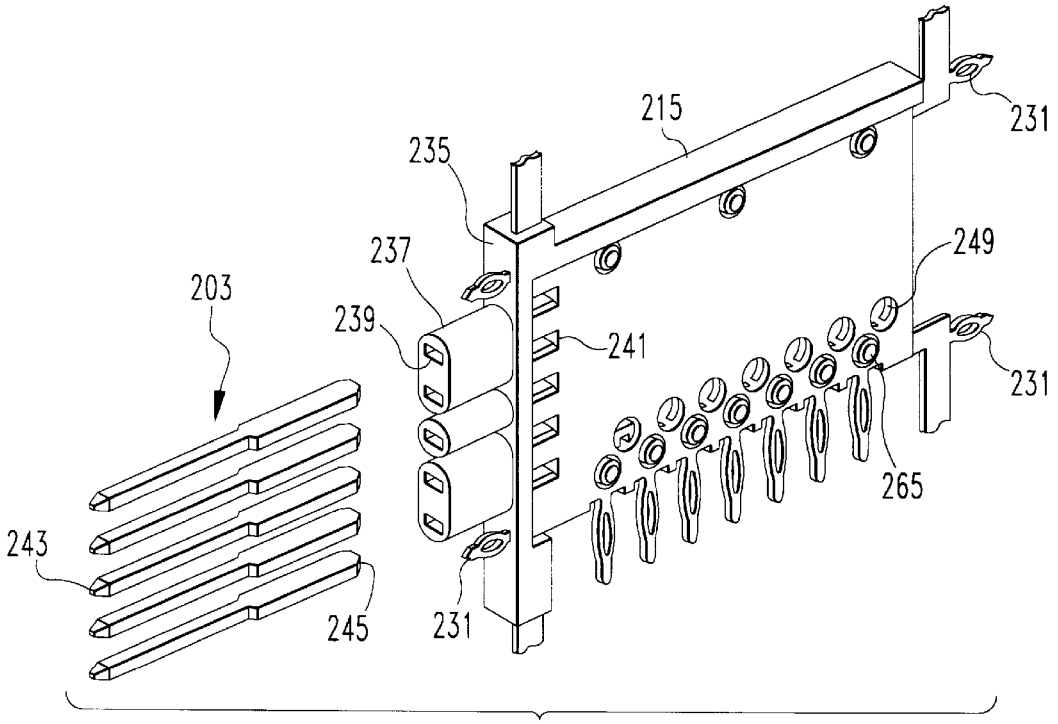
FIGS. 12–15 display various stages during the assembly of the connector shown in FIG. 10.

Pins 203 will now be described. As seen in FIG. 12, each pin 203 has a distal end 243 that engages the mating connector and a proximal end 245 that resides within sub-assembly 205. Although shown as a square pin, other shapes could be used.

Sub-assembly 205 will now be described with reference to FIGS. 11–13. Each sub-assembly 205 includes a first set of contacts 213 disposed along an edge of connector 200, an insulative housing 215, and a PCB 217.

Figure 11:
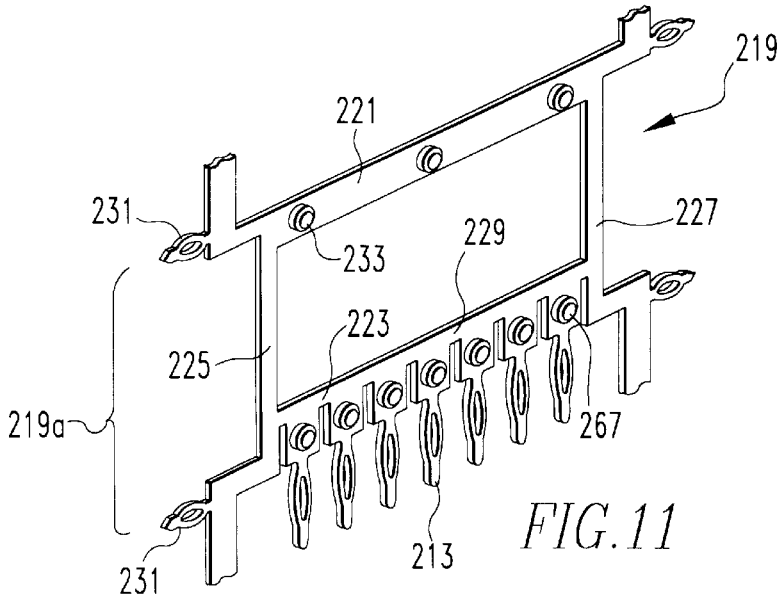
FIG. 11 is a perspective view of one component used in the connector shown in FIG. 10.

As seen in FIG. 11, terminal frame 219 provides contacts 213 to connector 200. Terminal frame 219, preferably contiguous, can be stamped and formed from a sheet of a suitable conductive material. Although terminal frame 219 may form only one sub-assembly 205, the figures display a continuous frame 219 with a column of terminal frame sections 219*a* that form a number of sub-assemblies 205.

Terminal frame section 219*a* has an upper member 221, a lower member 223, a forward member 225 and a rear member 227. Contacts 213 extend from lower member 223. At this point of the assembly of connector 200, a bridge 229 extends entirely between adjacent contacts 213.

Terminal frame section 219*a* may have auxiliary contacts 231 extending from forward member 225 and from rear member 227. When connector 200 is fully assembled, auxiliary contacts 231 may engage suitable apertures (not shown) in a conductive shroud 201 for grounding and shielding. In single ended applications, terminal frame section 219a may need only auxiliary contacts on forward member 225.

In row-oriented differential pair applications, terminal frame section 219*a* could also have auxiliary contacts 231 on rear member 227. When pairing the sub-assemblies, rear member 227 of one terminal frame section faces the conductive shroud, while forward member 225 of the other terminal frame section faces the conductive shroud. With this arrangement, auxiliary contacts 231 on both terminal frame sections 219*a* can engage the apertures in the conductive shroud.

Terminal frame section 219*a* can also have alignment posts 233 extending therefrom. Posts 233 help align frame 219 during formation of housing 215, act as solder pads to secure PCB 217 to housing 211 and provides optimum grounding to the connector. Posts 233 can be a dimple formed, for example, during the stamping process that creates frame 219 or the overmolding process that creates housing 205.

Housing 215 will now be described with reference to FIGS. 12 and 13. Housing 215 has a front face 235 from which ground contacts 231 and sleeves 237 extend. Sleeves 237 include at least one aperture 239 therethrough to accommodate proximal end 245 of pin 203. The centrally located pin 203 solely occupies one sleeve 237. In this specific arrangement, pin 203 carries ground and serves to shield the two differential pairs described below.

In order to team two pins 203, for example, as a column-oriented differential pair, sleeve 237 could include two apertures 239. Sleeves 237 reside within apertures 211 in shroud 201 to isolate pins 203 from conductive shroud 201 as seen in FIG. 15.

A cavity 241 communicates with apertures 239 in sleeves 237 and is sized to receive proximal end 245 of pin 203. A side wall of housing 215 has a recess 247 sized to accept PCB 217. Housing 215 also has apertures 249, 265 that correspond to the locations of bridges 229 and projections 233, respectively, on terminal frame 219. Apertures 249 reveal bridges 229 and allow tooling to enter from both sides of housing 205 to sever selected bridges 229. Apertures 265 surround posts 267 to allow PCB 217 to secure to contacts 213.

As with the PCB described in the first embodiment of the present invention, PCB 217can be formed from a suitable dielectric material. One side of PCB 217 can include a series of conductive pads flanking respective conductive traces for carrying, for example, signals therebetween. The other side of PCB 217 can also include a conductive trace to carry, for example, ground or can be entirely conductive to create a ground plane.

The assembly of connector 200 will now be described with reference to FIGS. 12–15. FIG. 12 demonstrates several steps involved in forming housing 215. The first step demonstrated in FIG. 12 is the formation of housing 215 in conjunction with terminal frame 219. Housing 215 should encase at least a portion of terminal frame 219, preferably by forming housing 215 around frame 219.

As discussed above, one possible method of encasing terminal frame 219 within housing 215 is overmolding housing 215 around frame 219, although other methods are possible. Frame 219 is initially positioned within a mold (not shown), then a suitable plastic material enters the mold and surrounds frame 219. As a result, the insulative material of housing 215 encases a portion of frame 219. Housing 215 forms, in essence, a unitary structure with frame 219. The overmolding process also forms apertures 249, 265 in housing 215.

As seen in FIG. 12, portions of terminal frame 219 can extend from housing 215. Preferably, contacts 213 and auxiliary contacts 231 extend from housing 215. Conversely, housing 215 surrounds the remainder of upper member 221, lower member 223, forward member 225 and rear member 227.

FIG. 12 also demonstrates the severing step. This step separates at least one contact 213 from terminal frame 219. The severing occurs, for example, by inserting tooling in both ends of apertures 249 to cut bridge 229.

Any of the bridges 229 in terminal frame 219 can be severed. As specifically shown in FIG. 12, the five centrally located contacts 213 are severed from frame 219 and from each other. In other words, the five centrally located contacts 213 are discontinuous with frame 219 and with each other. As seen in FIG. 13, four of the five contacts 213 can form two column-oriented differential pairs to carry signals, separated by the fifth contact 213 in the middle which could carry ground and would serve to separate the column-oriented differential pairs.

The two remaining contacts 213 (i.e. contacts 213 closest to forward member 225 and rear member 227, respectively) may remain contiguous with terminal frame 219 and with each other. Preferably, these two contacts 213 are ground contacts. The two contacts 213, the contiguous portion of frame 219 and auxiliary contacts 225 provide shielding to connector 200.

Another step in the assembly of connector 200 places pins 203 in housing 215. FIG. 12 demonstrates housing 215 prior to pin insertion. Proximal end 245 of pin 203 enters aperture 239 of sleeve 237 and cavity 241 of housing 215. Pins 203 can remain within cavity 241 during the assembly process using, for example, an interference fit. FIG. 13 demonstrates pins 203 inserted into housing 215.

Figure 13:
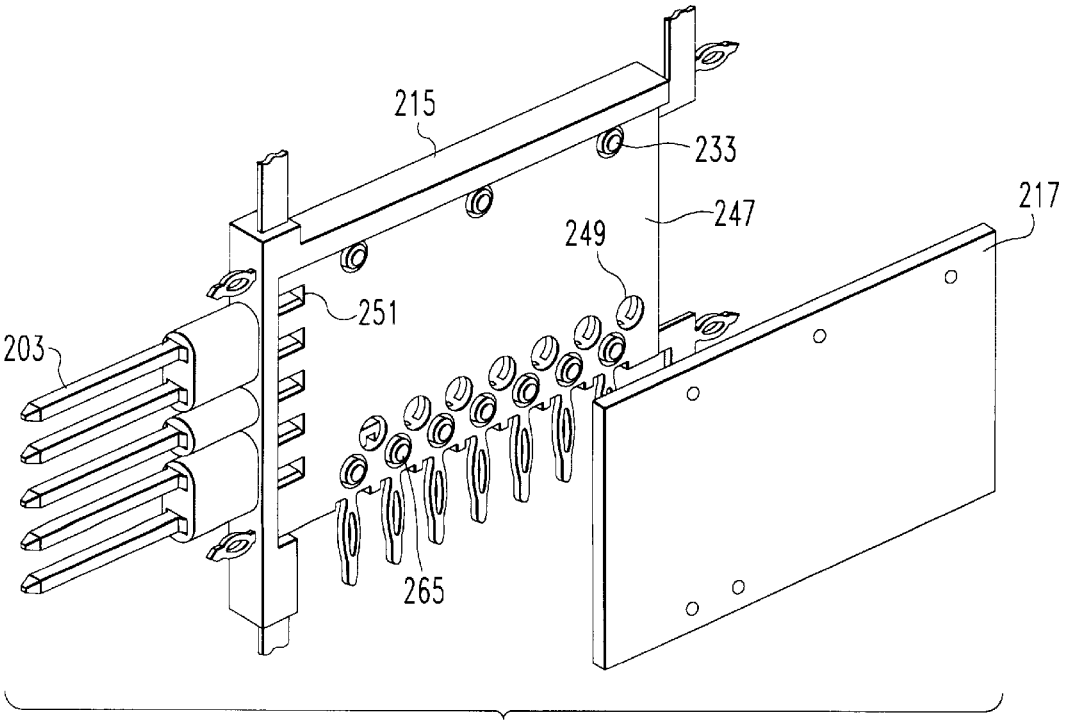

FIG. 13 demonstrates several other steps in the assembly process. Terminal frame section 219*a* is severed from the remainder of frame 219. Specifically, this step severs terminal frame section 219*a* at four locations: the two portions of terminal frame 219 that extend from the top of housing 215; and the portions of terminal frame 219 that extend from the bottom of housing 215.

Figure 14:
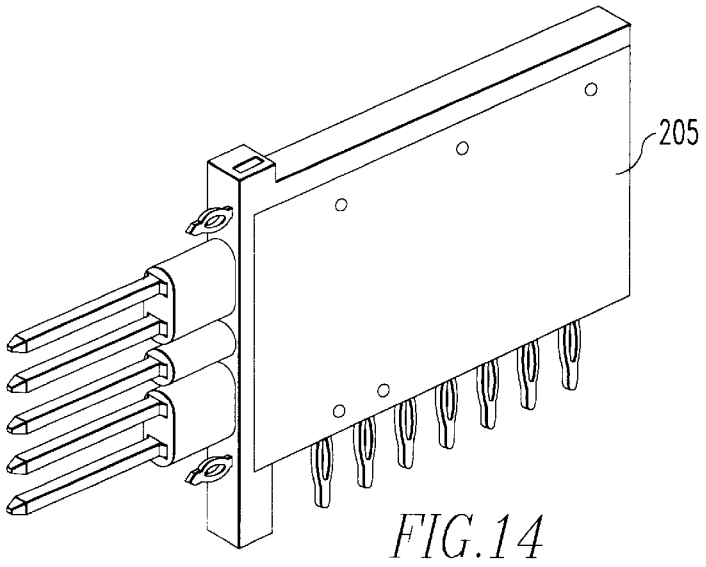

FIG. 13 also demonstrates the merger of housing 215 and PCB 217. Solder paste (not shown) is placed on the pads of PCB 217. Then, PCB 217 is inserted into recess 247 of housing 215, with some pads aligned with posts 233 and other pads aligned with a side 251 of proximal end 245 of pin 203. A known reflow step melts the solder paste and joins the pads with posts 233 and sides 251 of pins 203. Alternately, laser welding can be used. FIG. 14 displays an assembled sub-assembly 205.

Figure 15:
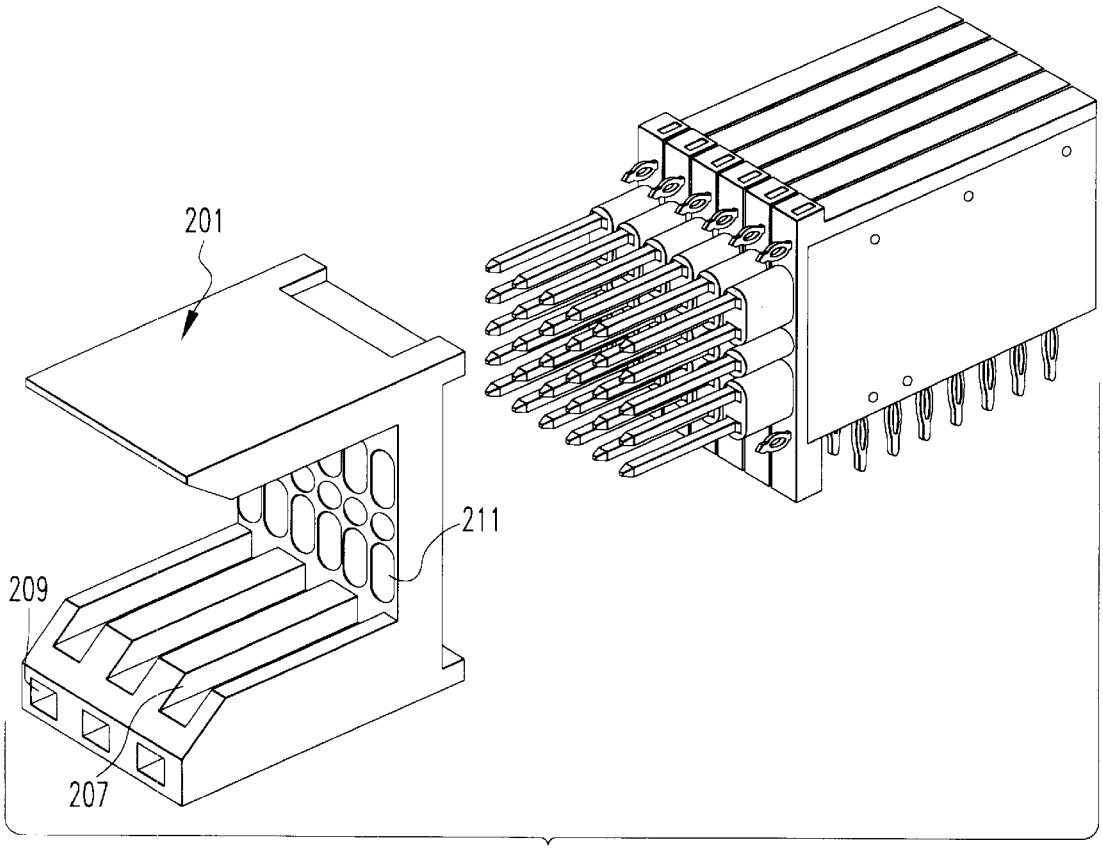

FIG. 15 demonstrates the final step in the assembly of connector 200. Several sub-assemblies 205, arranged side-by-side, enter shroud 201. Shroud 201 accepts pins 203 and sleeves 237 so that sleeves 237 reside within apertures 211 and pins 203 extend from the base of shroud 201 and reside between the walls of shroud 201 for protection. FIG. 10 demonstrates an assembled connector 200.

Although both embodiments described terminal frames utilizing all press-fit pins as contacts 103, 213, other types of contacts could be used. For instance, FIG. 16*a* demonstrates a terminal frame 219' having one contact 213' with a press-fit pin 253' and several contacts 213' with fusible elements 255' secured thereto. As with the earlier alternative embodiments, press-fit pin 253' helps ground the connector and serves a retention function. Fusible elements 255' can be solder balls that are subsequently reflowed to surface mount the connector to a substrate (not shown) using ball grid array (BGA) technology.

Alternatively, FIG. 16*b* demonstrates that terminal frame 219" can have one contact 213" with a press-fit pin 257" and several contacts 213" with a pin-in-paste design. As with the earlier alternative embodiments, press-fit pin 257" helps ground the connector and serves a retention function. The pin-in-paste design utilizes a distal end 259" that enters a through hole (not shown) filled with solder paste (not shown) on the substrate (not shown). Reflow of the solder paste secures distal end 255" of contacts 213" within the through hole.

Finally, FIG. 16*c* demonstrates that terminal frame 219'" can have one contact 213'" with a press-fit pin 261'" and several contacts 213'" with a surface mount tail design. As with the earlier alternative embodiments, press-fit pin 261'" helps ground the connector and serves a retention function. The surface mount contacts have a bent tail 263'" that rests on the substrate (not shown). Bent tail 263'" is then soldered to the substrate.

Figure 17:
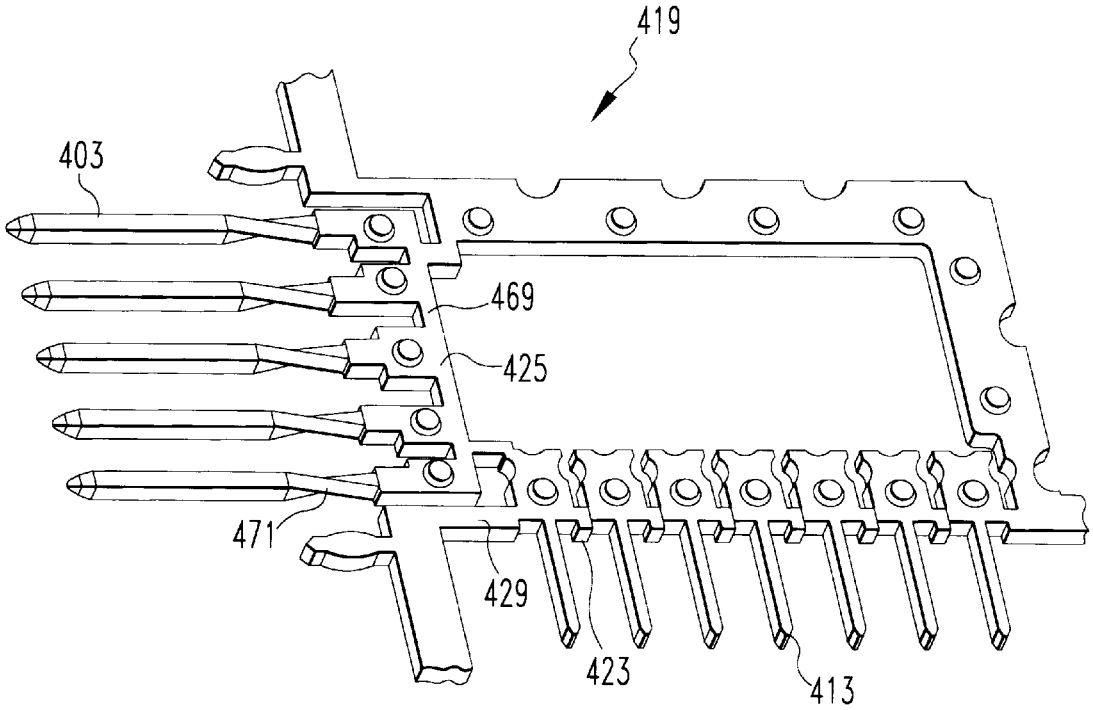
FIG. 17 is a perspective view of one component of another alternative embodiment of the present invention.

FIG. 17 will be used to describe another alternative embodiment of the present invention. This alternative embodiment is similar to the embodiment shown in FIGS. 10–15 and will use the same reference characters, save a change in the hundreds digit. Aside from the differences described below, the connector of this embodiment could be assembled in any of the aforementioned manners.

As with the other embodiments, contacts 413 extend from lower member 423 of lead frame 419. Differently than the other embodiments, however, pins 403 are unitary with lead frame 419. As seen in FIG. 17, pins 403 extend from forward member 425. Similar to bridges 423 between adjacent contacts 413, bridges 469 extend between adjacent pins 403.

Bridges 469 preferably reside within the housing (not shown) after the overmolding step. Bridges 423, however, could reside within the housing or reside in a notched area of the housing as described earlier with reference to FIGS. 4 and 4*a*, respectively.

In order to provide a smoother mating surface for contact with a dual beam contact (not shown) of a mating connector (not shown), pins 403 can have a twist 471 at an intermediate portion. Although shown as a rotation of 90°, other angles are possible.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A first terminal frame at least partially locatable within an insulative housing of an electrical connector and adjacent a second terminal frame, the first terminal frame comprising:

a plurality of contacts;

bridges extending between adjacent contacts; and an auxiliary contact which forms a first beam of a dual beam contact;

wherein a second beam of said dual beam contact is formed by an auxiliary contact of said second terminal frame.

2. The terminal frame as recited in claim 1, further comprising a perimeter, wherein said contacts extend from said perimeter.

3. The terminal frame as recited in claim 2, wherein said perimeter bounds an open central area.

4. The terminal frame as recited in claim 2, wherein said plurality of contacts reside along one edge of said perimeter.

5. The terminal frame as recited in claim 2, a portion of said plurality of contacts reside along one edge of said perimeter and a remainder of said plurality of contacts reside along an adjacent edge of said perimeter.

6. The terminal frame as recited in claim 1, wherein the terminal frame includes a plurality o f terminal frame sections, each associated with an insulative housing of a respective electrical connector.

7. The terminal frame as recited in claim 6, wherein one of said terminal frame section s is a generally mirror image of another terminal frame section.

8. An electrical connector mountable on a substrate and adapted to engage a mating connector, the connector comprising:

a plurality of modules, each module including:

an insulative housing;

a plurality of first contacts at least partially surrounded by said insulative housing, said first contacts adapted to engage the substrate;

bridges extending between adjacent first contacts;

a plurality of second contacts for engaging contacts on the mating connector; and a circuit substrate having conductive traces thereon extending between at least some of said first and second contacts.

9. The electrical connector as recited in claim 8, wherein said first contacts of at least two of said modules are from a common terminal frame.

10. The electrical connector as recited in claim 9, wherein a portion of said common terminal frame used with one of said modules is generally a mirror image of another portion of said common terminal frame used with another of said modules.

11. The electrical connector as recited in claim 10, wherein said mirror image portions of said common terminal frame reside in adjacent modules.

12. The electrical connector as recited in claim 11, wherein said adjacent modules are connected by a junction joining said portions of said common terminal frame.

13. The electrical connector as recited in claim 8, wherein said insulative housing is overmolded around at least a portion of said first contacts.

14. The electrical connector as recited in claim 13, wherein said insulative housing surrounds at least one of said bridges.

15. The electrical connector as recited in claim 14, wherein said insulative housing includes an aperture revealing at least one of said bridges.

16. The electrical connector as recited in claim 15, wherein said aperture extends completely through said insulative housing.

17. The electrical connector as recited in claim 13, wherein at least one of said bridges is located outside of said housing.

18. The electrical connector as recited in claim 17, wherein said at least one bridge located outside said housing resides in a notched area in said housing.

19. The electrical connector as recited in claim 8, wherein at least some of said bridges are discontinuous.

20. The electrical connector as recited in claim 19, further comprising a frame residing within said insulative housing and connected at least one of said first contacts.

21. The electrical connector as recited in claim 20, wherein at least one of said second contacts are connected to said frame.

22. The electrical connector as recited in claim 20, wherein said plurality of first contacts reside in a row, and the first and last contacts in said row are connected to said frame.

23. The electrical connector as recited in claim 22, further comprising an auxiliary contact connected to said frame.

24. The electrical connector as recited in claim 23, wherein said auxiliary contact forms one beam of a dual beam contact, the other beam of the dual beam contact formed by an auxiliary contact of a terminal frame of an adjacent module.

25. The electrical connector as recited in claim 20, wherein said frame has a peripheral extent and an open central area.

26. The electrical connector as recited in claim 8, wherein said insulative housing comprises at least one opening for receiving said second contacts.

27. The electrical connector as recited in claim 8, further comprising a shroud for protecting said second contacts.

28. The electrical connector as recited in claim 27, wherein said insulative housing has at least one sleeve extending therefrom, surrounding said second contacts and received within said shroud.

29. The electrical connector as recited in claim 28, wherein one sleeve surrounds two of said second contacts.

30. The electrical connector as recited in claim 8, wherein said terminal frame further comprises at least one projection for interacting with said insulative housing.

31. The electrical connector as recited in claim 8, further comprising bridges extending between adjacent second contacts.

32. A method of making an electrical connector mountable on a substrate and adapted to engage a mating connector, comprising the steps of:

providing a plurality of modules, each module formed by the steps of:

providing a terminal frame, comprising:

a plurality of first contacts adapted to engage the substrate; and a bridge extending between adjacent first contacts;

providing an insulative housing;

at least partially surrounding said terminal frame with said insulative housing;

providing a plurality of second contacts for engaging contacts on the mating connector;

providing a circuit substrate with conductive traces thereon; and connecting said first and second contacts to said conductive traces on said circuit substrate; and arranging said modules.

33. The method of making an electrical connector as recited in claim 32, wherein said second contacts are part of said terminal frame.

34. The method of making an electrical connector as recited in claim 32, further comprising the steps of:

providing a shroud; and connecting said modules to said shroud.

35. The method of making an electrical connector as recited in claim 33, wherein the terminal frame surrounding step includes the step of surrounding at least one of said bridges with said insulative housing.

36. The method of making an electrical connector as recited in claim 35, further comprising the step of severing at least some of said bridges.

37. The method of making an electrical connector as recited in claim 32, wherein the terminal frame surrounding step comprises the step of overmolding said housing around said terminal frame.

38. The method of making an electrical connector as recited in claim 37, wherein the overmolding step of at least two of said modules occurs generally simultaneously.

39. The method of making an electrical connector as recited in claim 37, wherein the arranging step includes the step of placing the simultaneously formed modules adjacent one another.

40. The method of making an electrical connector as recited in claim 37, wherein the overmolding step includes the step of forming at least one aperture in said insulative housing to reveal at least one of said bridges.

41. The method of making an electrical connector as recited in claim 40, further comprising the step of severing at least one of said bridges through said at least one aperture.

42. The method of making an electrical connector as recited in claim 32, further comprising the step of severing at least some of said bridges.

43. The method of making an electrical connector as recited in claim 42, wherein the severing step occurs subsequent to the surrounding step.

44. The method of making an electrical connector as recited in claim 32, further comprising the step of severing said terminal frame from a common terminal frame used to form more than one module.

45. The method of making an electrical connector as recited in claim 44, wherein one of said terminal frames is a generally mirror image of another said terminal frame.

46. The method of making an electrical connector as recited in claim 45, wherein the arranging step comprises the step of placing said modules having mirror image terminal frames adjacent one another.

47. The method of making an electrical connector as recited in claim 46, wherein the placing step comprises the step of bending said common terminal frame.

* * * * *